US006428310B1

(12) United States Patent
Nicholas G.

(10) Patent No.: US 6,428,310 B1
(45) Date of Patent: Aug. 6, 2002

(54) APPARATUS AND METHOD FOR FORMING AND PACKAGING VOTIVE CANDLES

(76) Inventor: Scannell Nicholas G., 2138 Harris Cres., Suite 10, Burlington, Ontario (CA), L7R 1G4

( * ) Notice: Subject to any disclaimer, the term of this patent is extended or adjusted under 35 U.S.C. 154(b) by 0 days.

(21) Appl. No.: 09/690,009

(22) Filed: Oct. 17, 2000

(51) Int. Cl.[7] ..... F23D 3/16

(52) U.S. Cl. ..... 431/291; 431/288; 249/94; 249/112; 425/803

(58) Field of Search ..... 431/291, 292, 431/288, 294, 289; 206/562, 563, 564; 249/94, 112, 93, 164, 114.1; 425/803; 264/247, 259, 279.1

(56) References Cited

U.S. PATENT DOCUMENTS

| | | | | |
|---|---|---|---|---|
| 2,025,096 A | * | 12/1935 | Deckert | 431/291 |
| 2,071,856 A | | 2/1937 | Segal | 206/56 |
| 2,137,701 A | | 11/1938 | Replogle | 67/21 |
| 2,137,707 A | | 11/1938 | Wade et al. | 67/21 |
| 2,143,576 A | | 1/1939 | Replogle et al. | 18/48 |
| 3,403,714 A | | 10/1968 | Hulm | 150/0.5 |
| 3,483,908 A | | 12/1969 | Donovan | 150/0.5 |
| 3,752,433 A | | 8/1973 | Berman | |
| 4,004,773 A | | 1/1977 | Binder | |
| 4,444,308 A | | 4/1984 | MacEwen | 206/249 |
| 5,121,835 A | | 6/1992 | Grupe | |
| 5,660,281 A | * | 8/1997 | James | 431/292 |
| 5,879,151 A | | 3/1999 | Schultz et al. | 431/291 |
| 6,036,024 A | | 3/2000 | Seidler | 206/780 |

FOREIGN PATENT DOCUMENTS

| | | | | |
|---|---|---|---|---|
| DE | 20005930 | | 7/2000 | |
| GB | 1011052 | | 11/1965 | |
| GB | 2175994 A | | 12/1986 | |
| IT | 441387 | * | 10/1948 | 431/291 |

* cited by examiner

*Primary Examiner*—James C. Yeung
(74) *Attorney, Agent, or Firm*—Bereskin & Parr

(57) ABSTRACT

A container for forming the packaging of a candle consists of a cup having a closed bottom, a cylindrical sidewall integrally connected to the bottom, and an open top. The cup is shaped to conform to the inside surface of a mold for forming a votive candle from molten wax. The cup is made from a material, preferably clear PVC, capable of withstanding heat generated by the molten wax. The sidewall of the cup is sufficiently rigid to provide protection for the candle during shipping and the bottom of the cup is sufficiently flexible to allow the candle to be ejected from the cup by applying upwardly directed pressure thereto.

14 Claims, 2 Drawing Sheets

APPARATUS AND METHOD FOR FORMING AND PACKAGING VOTIVE CANDLES

FIELD OF THE INVENTION

The present invention relates to candles, and in particular, to apparatus and methods for forming and packaging votive candles.

BACKGROUND OF THE INVENTION

Candles come in a wide variety of styles, shapes, colors and fragrances. Scented votive candles are a very popular type of candle. A votive candle is a short, cylindrical candle, typically about 2–2.5 inches in height, and about 1.5–1.75 inches in diameter. Scented votive candles come in a wide variety of fragrances, including fragrances associated with herbs, spices, fruits and flowers. In use, votive candles provide an ambience suitable for various occasions, and votive candles with essential oils can be used for aromatherapy.

Votive candles are typically formed either by a traditional pouring process, in which hot liquid wax is poured into steel molds in the shape of a candle, or by an automatic molding machine having a plurality of molding cavities. The pouring process produces a candle having a hand-made look, whereas the automatic molding process produces a candle having lower dimensional tolerances. In either case, once the wax cools, the candle shrinks slightly, allowing the candle to be removed from the mold cups or cavities, and packaged for distribution and sale.

Poured votive candles are typically packaged by placing a quantity (typically 12–18) of bare candles in a box for shipment to retail outlets. The retailer then places the box on a stand or a shelf and opens the box to display the candles. This form of packaging has certain drawbacks. It does not provide much protection for individual candles during shipping, and it does not allow for the candles to be individually labelled. In addition, exposed candles tend to collect dust and fingerprints resulting from handling by consumers.

Some votive candles, particularly machine molded votive candles, are individually shrink wrapped prior to shipping, using automatic shrink wrapping machines. This form of packaging reduces the accumulation of dust and fingerprints, and allows for labelling. However, shrink wrapping has certain drawbacks. Many votive candles contain fragrance oils which tend to permeate through the shrink wrap, saturating the labels and rendering any affixed bar codes inoperable. Shrink wrapping requires the use of expensive machinery, and lengthens the duration of the production cycle. Since the candle tends to be fully encased within the shrink wrap, the fragrance is suppressed, making it difficult for consumers to test the scent of the candle before purchase. Shrink wrapping does not provide much protection from damage during shipping.

There is accordingly a need for a simple and inexpensive process for forming and packaging votive candles, which provides for improved protection during shipping and handling, which does not adversely affect bar-codes, and which allows consumers to see and smell the product on display.

SUMMARY OF THE INVENTION

The present invention is directed towards a container for forming and packaging a candle. The container comprises a cup having a closed bottom, a cylindrical sidewall integrally connected to the bottom, and an open top. The cup is shaped to conform to the inside surface of a mold for forming a candle from molten wax. The cup is made of a material capable of withstanding heat generated by the molten wax during formation of the candle. The sidewall is sufficiently rigid to provide protection for the candle during shipping, and the bottom is sufficiently flexible to allow the candle to be ejected from the cup by applying upwardly directed pressure thereto.

The present invention is also directed to a method for forming and packaging a candle The subject method comprises the steps of providing a container comprising a cup having a closed bottom and a cylindrical sidewall, the cup being shaped to conform to the inside surface of a mold for forming a candle, and capable of withstanding the heat generated from molten wax, placing the container into the mold, introducing a wick into the container, dispensing molten wax into the container, and cooling the mold containing the container and the wax, thereby allowing the container and the candle to be removed from the mold and subsequently distributed as a package.

BRIEF DESCRIPTION OF THE DRAWINGS

The invention will now be described, by way of example only, with reference to the accompanying drawings, in which.

DETAILED DESCRIPTION OF THE PREFERRED EMBODIMENTS

Figure 1:
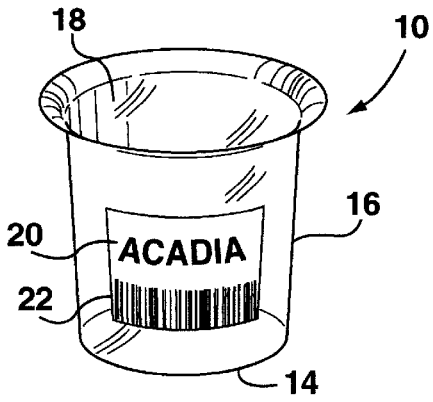
FIG. 1 is a perspective view of a container for forming packaging votive candles, made in accordance with a preferred embodiment of the invention.
Figure 2:
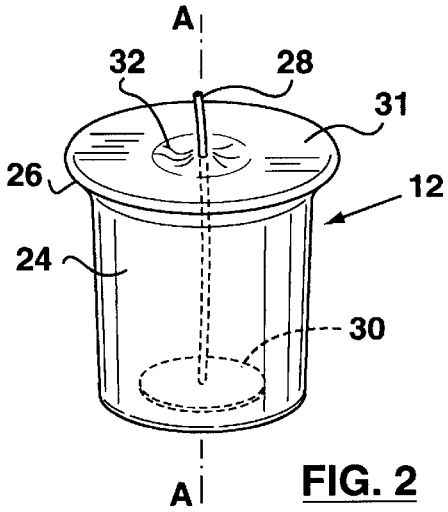
FIG. 2 is a perspective view of a votive candle formed through use of the container shown in FIG. 1.

Referring to FIGS. 1 and 2, illustrated therein is a container 10 for forming and packaging a votive candle 12, made in accordance with a referred embodiment of the subject invention. Container 10 is shaped in he form of a cup having a closed bottom 14, a generally cylindrical, slightly tapered sidewall 16, and an open top 18. A paper label 20 and bar-code 22 may be affixed to the outside surface of sidewall 16.

Votive candle 12 is made of wax, and comprises generally cylindrical, slightly tapered main body 24, having an outwardly flared upper lip 26, a wick 28 embedded within main body 24 and extending along longitudinal axis A—A, and a metal sustainer 30, wherein wick 28 is attached to the top surface of sustainer 30. Candle 12 is preferably a scented votive candle made of refined paraffin wax containing synthetic or natural fragrance oils such as essential oils. Top surface 31 of votive candle 12 may have a central indentation 32 around wick 28 depending upon how the wax cools during the molding process.

Figure 3:
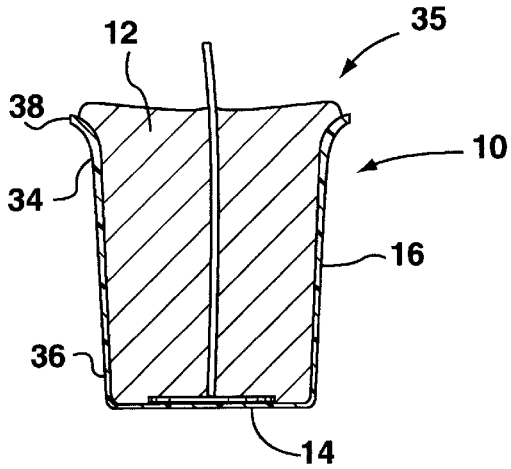
FIG. 3 is a cross-sectional view of a candle-container package of the subject invention.

Referring now to FIG. 3, illustrated therein is a candle 12 positioned within container 10, hereinafter referred to as candle-container package 35. The wall thicknesses of the various portions of container 10 are exaggerated for clarity. Sidewall 16 of container 10 comprises upper sidewall portion 34, and lower sidewall portion 36. Container 10 also includes a flared lip portion 38 which extends outwardly around the periphery of sidewall 16. Upper sidewall portion 34 should be rigid enough to provide protection for candle 12 during shipping and handling. Bottom 14 should be sufficiently flexible to allow a purchaser to easily eject candle 12 from container 10 by applying upwardly directed finger or thumb pressure to bottom 14. As shown, the wall thickness of upper sidewall portion 34 is greater than the wall thickness of lower sidewall portion 36 and bottom 14.

Container 10 is made from a material capable of withstanding the heat generated by molten wax during formation of candle 12, the temperature of which typically falls within a range of about 170° F. to about 185° F. Container 10 is preferably made from a clear thermoplastic film, such as PVC (polyvinyl chloride) having a softening point of at least 185° F., although other plastics having the aforesaid characteristics could be utilized to make container 10. Container 10 may be formed by a known manner, e.g. by means of a conventional thermoforming process. In the preferred embodiment, the thermoforming tolerances are +0.254 mm and 0.762 mm. In the case of a container 10 made of PVC, the wall thickness of upper sidewall portion 34 preferably falls within the range of about 0.015 to 0.025 inches, and the wall thickness of bottom 14 preferably falls within the range of about 0.010 inches to about 0.015 inches. Preferably, the wall thickness of lower sidewall portion 36 is about the same as the wall thickness of bottom 14. In the preferred embodiment, the wall thickness of upper sidewall portion 34 is about 0.020 inches and the wall thickness of lower sidewall portion 36 and bottom 14 is about 0.010 inches.

Figure 4:
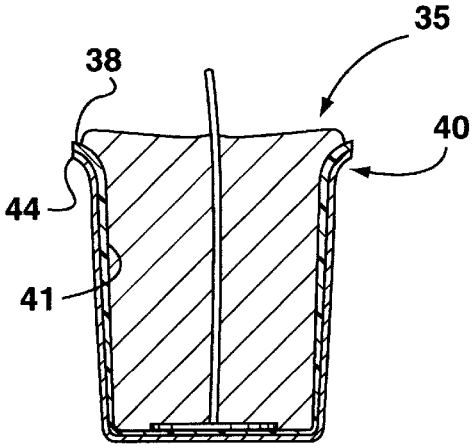
FIG. 4 is a cross-sectional view of the subject container and candle package, shown in a mold.

Referring to FIG. 4, candle-container package 35 is shown positioned within mold 40 shaped for forming a votive candle. Container 10 is shaped to conform to the inside surface 41 of mold 40. Lip portion 38 of container 10 is shaped to conform to the inside surface of lip 44 of mold 40, to provide a good seal and prevent wax from seeping in between container 10 and mold 40 during the molding process. It has been found when the molten wax cools to room temperature, the resulting candle 12 acquires a self lubricating property which allows candle 12 to be easily ejected from container 10.

Figure 5:
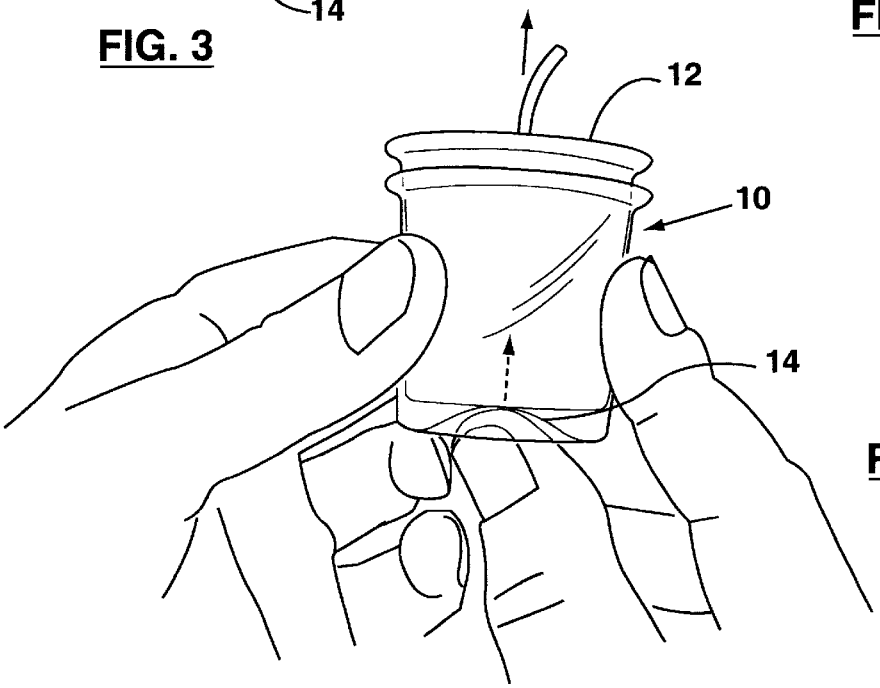
FIG. 5 is a sectional view showing a votive candle being ejected from the subject container by applying pressure to the bottom thereof.

Referring now to FIG. 5, a candle 12 is shown in the process of being removed from container 10. Container 10 is held and an upward force is applied to the relatively thin flexible bottom 14 to push the candle 12 out of the container 10. Any fragrance oils in candle 12 help to lubricate the inner surface of the cylindrical sidewall 16 and aid in sliding candle 12 out of container 10.

Figure 6:
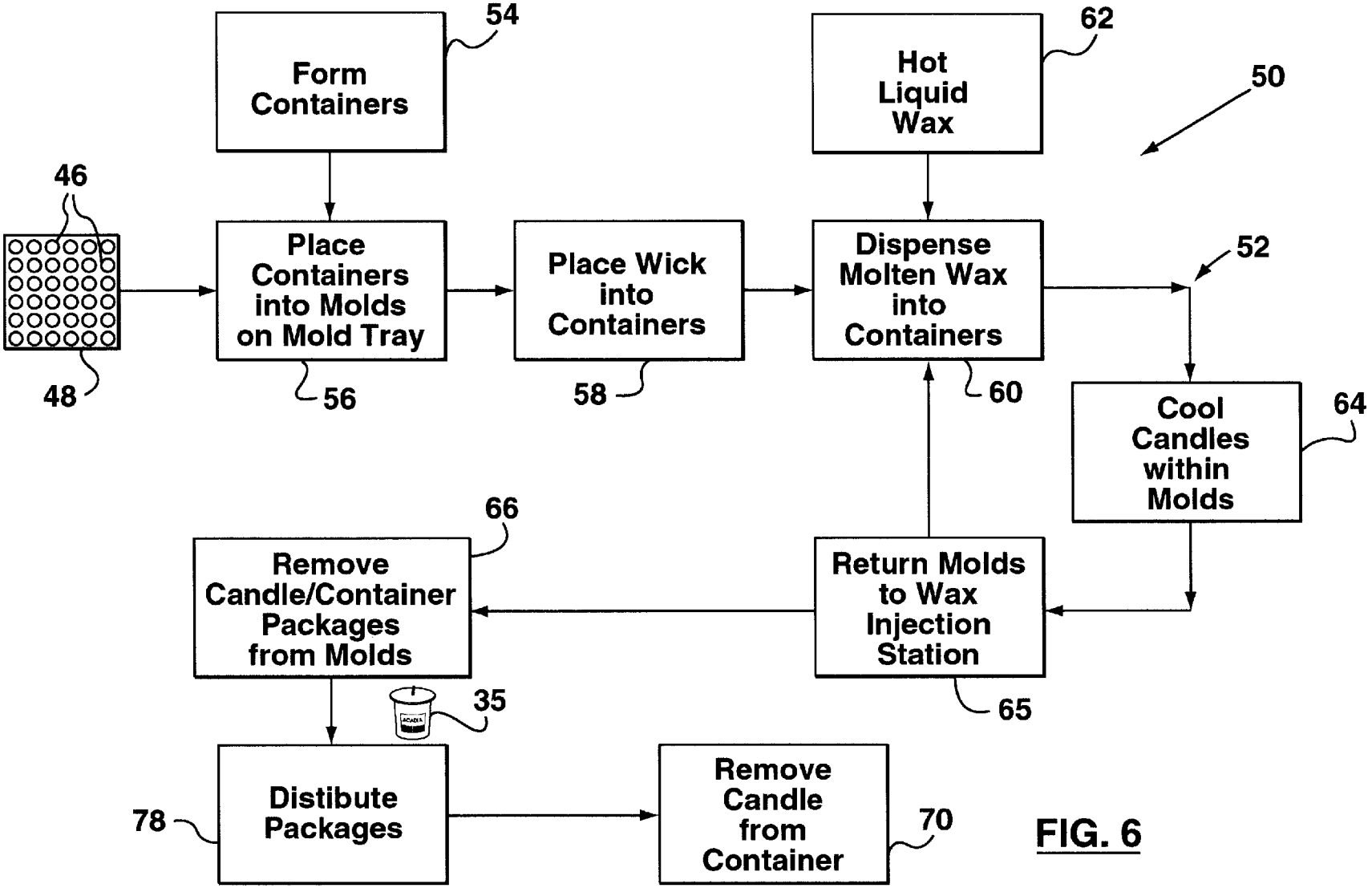
FIG. 6 is a block diagram illustration a method for forming and packaging votive candles in accordance with the subject invention.

Referring now to FIG. 6, the present invention is also directed to a method 50 for forming and packaging a candle, utilizing known assembly line apparatus 52 for forming votive candles by pouring molten wax into molds. In step 54, containers 10 are formed by a conventional forming process. At step 56, containers 10 are placed into molds 46 mounted on mold trays 48. In the preferred embodiment, mold tray 48 has 36 evenly spaced molds 46, and containers 10 are placed by hand into molds 46. In step 58, a sustainer with wick attached thereto is placed in the bottom of containers 10 in mold 46. In step 60, molten wax from liquid wax station 62 is dispensed into containers 10 at a wax injection station, preferably by conventional wax injection apparatus comprising a plurality of injectors. Mold tray 46 then proceeds to a cooling station, where at step 64, mold trays 46 are cooled for a period of time, typically about an hour, causing candles 12 to shrink slightly. At step 65, mold tray 46 is returned to the wax injection station wherein containers 10 are topped up with wax and returned to the cooling. station. Mold tray 46 then proceeds to the end of the line where, at step 66, candle-container packages 35 are removed from molds 46. At step 68, candle-container packages 35 are placed in boxes and distributed to retailers. Once a package 35 is sold, candle 12 may be easily ejected from container 10 at step 70, by applying upwardly directed pressure to bottom 14 of container 10. Preferably, a user grasps sidewall 16 of package 35, and applies upwardly directed thumb pressure to bottom 14.

In this method, the candle forming and packaging steps are conveniently combined into a single step. This eliminates the need for expensive packaging machinery and also reduces the production cycle time, thus increasing output efficiency.

The present invention has many advantages over the prior art. Container 10 offers protection during shipping and handling of the candle which minimizes any damage to the lip and other surface portions of the candle. Additionally, since container 10 has an open top 18, approximately 10% of the fragrance is released to allow the consumer to smell the candle before purchasing the product. Moreover, since container 10 is transparent, the consumer is able to see the colour and any decoration on the surface of the candle.

Also, cylindrical sidewall 16 of container 10 is capable of accepting a sticker displaying a bar-code. Alternatively, the bar-code can be placed on bottom 14 of container 10. The addition of bar-codes to the product facilitates computerized inventory control and simplifies the purchasing process by allowing quick scanning at the cash register. The present invention overcomes the deficiencies in the prior art since the relatively thick sidewalls 16 of container 10 do not allow the fragrance oils in candle 12 to permeate through to the bar-code and destroy its utility.

It should be understood that various modifications can be made to the preferred embodiments described herein without departing from the subject invention, the scope of which is defined in the appended claims.

I claim:

1. A container for forming and packaging a candle, comprising a cup having a closed bottom, a cylindrical sidewall integrally connected to the bottom, and an open top, the cup being shaped to conform to the inside surface of a mold for forming a candle from molten wax, the cup being made from a material capable of withstanding heat generated by the molten wax during formation of the candle, wherein the sidewall is sufficiently rigid to provide protection for the candle during shipping, and wherein the bottom of the cup is sufficiently flexible to allow the candle to be ejected from the cup by applying upwardly directed pressure thereto.

2. The container defined in claim 1, wherein the sidewall and the bottom of the cup each have a selected wall thickness, and the wall thickness of the bottom is less than the wall thickness of at least an upper portion of the sidewall.

3. The container defined in claim 2, wherein the sidewall has a lower portion having a selected wall thickness, and the wall thickness of the lower portion of the sidewall is less than the wall thickness of the upper portion of the sidewall.

4. The container defined in claim 3, wherein the wall thickness of the bottom is approximately the same as the wall thickness of the lower portion of the sidewall.

5. The container defined in claim 1, wherein the cup has an outwardly flared lip extending around the top of the sidewall.

6. The container defined in claim 1, wherein the cup is made from a plastic material.

7. The container defined in claim 6, wherein the plastic material is transparent.

8. The container defined in claim 6, wherein the plastic material is polyvinyl chloride.

9. The container defined in claim 8, wherein the sidewall has a wall thickness falling within a range of about 0.020 inches to about 0.010 inches.

10. Apparatus for forming and packaging a candle, comprising:

(a) a metallic mold shaped to form a candle from molten wax; and (b) a cup having a closed bottom, a cylindrical sidewall integrally connected to the bottom, and an open top, the cup being shaped to conform to the inside surface of the mold;

(c) wherein the cup is made from a material capable of withstanding heat generated by the molten wax during formation of the candle;

(d) wherein the sidewall is sufficiently rigid to provide protection for the candle during shipping; and (e) wherein the bottom of the cup is sufficiently flexible to allow the candle to be ejected from the cup by applying upwardly directed pressure thereto.

11. The container defined in claim 10, wherein the sidewall and the bottom of the cup each have a selected wall thickness, and the wall thickness of the bottom is less than the wall thickness of at least an upper portion of the sidewall.

12. The container defined in claim 11, wherein the sidewall has a lower portion having a selected wall thickness, and the wall thickness of the lower portion of the sidewall is less than the wall thickness of the upper portion of the sidewall.

13. The container defined in claim 12, wherein the wall thickness of the bottom is approximately the same as the wall thickness of the lower portion of the sidewall.

14. The container defined in claim 10, wherein the cup has an outwardly flared lip extending around the top of the sidewall.

* * * * *